US006237364B1

(12) United States Patent
Stone

(10) Patent No.: US 6,237,364 B1
(45) Date of Patent: May 29, 2001

(54) PROCESS FOR PRODUCING A PRESSURIZED METHANE-RICH LIQUID FROM A METHANE-RICH GAS

(75) Inventor: John B. Stone, Kingwood, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/464,986

(22) Filed: Dec. 16, 1999

Related U.S. Application Data

(60) Provisional application No. 60/115,980, filed on Jan. 15, 1999.

(51) Int. Cl.[7] ..... F25J 1/00
(52) U.S. Cl. ..... 62/613
(58) Field of Search ..... 62/46.1, 613, 632

(56) References Cited

U.S. PATENT DOCUMENTS

| | | | |
|---|---|---|---|
| 3,733,838 | 5/1973 | Delahunty | 62/54 |
| 3,735,600 | 5/1973 | Dowdell et al. | 62/39 |
| 3,857,245 | 12/1974 | Jones | 60/651 |
| 3,861,160 | 1/1975 | Walker | 62/48 |
| 3,907,515 | 9/1975 | Mulliner | 44/2 |
| 4,010,622 | 3/1977 | Etter | 62/48 |
| 4,187,689 | 2/1980 | Selcukoglu et al. | 62/54 |
| 4,689,962 | 9/1987 | Lofredo | 62/54 |
| 4,697,426 | 10/1987 | Knowles | 62/48 |
| 4,727,723 | 3/1988 | Durr | 62/54 |
| 5,950,453 | 9/1999 | Bowen et al. | 62/612 |

FOREIGN PATENT DOCUMENTS

| | | | |
|---|---|---|---|
| 2333149A | 7/1999 | (GB) | F25J/1/02 |

OTHER PUBLICATIONS

Bennett, C. P. Marine Transportation of LNG at Intermediate Temperature, *CME* (Mar. 1979), pp. 63–64.

Faridany, E. K., Secord, H.C, O'Brien, J. V., Pritchard, J. F., and Banister, M. The Ocean Phoenix Pressure–LNG System, *Gastech 76* (1976), New York, pp. 267–280.

Faridany, E. K., Ffooks R. C., and Meikle, R. B. A Pressure LNG System, *European Offshore Petroleum Conference & Exhibition* (Oct. 21–24, 1980), vol. EUR 171, pp. 245–254.

Broeker, R. J. CNG and MLG–New Natural Gas Transportation Processes, *American Gas Journal* (Jul. 1969) pp. 138–140.

Fluggen, Prof. E. and Backhaus, Dr. I. H. Pressurised LNG—and the Utilisation of Small Gas Fields, *Gastech 78, LNG/LPG Conference* (Nov. 7, 1978), Monte Carlo pp. 195–204.

Broeker, R.J. A New Process for the Transportation of Natural Gas, *Proceedings of the First International Conference on LNG* (1968), Chicago, Illinois, Session No. 5, Paper 30, pp. 1–11.

Ladkany, S. G. Composite Aluminum–Fiberglass Epoxy Pressure Vessels for Transportation of LNG at Intermediate Temperature, published in *Advances in Cryogenic Engineering, Materials,* vol. 28, (Proceedings of the 4th International Cryogenic Materials Conference), San Diego, CA, USA, Aug. 10–14, 1981, pp. 905–913.

*Primary Examiner*—William Doerrler
*Assistant Examiner*—Malik N. Drake
(74) *Attorney, Agent, or Firm*—Gary D. Lawson

(57) ABSTRACT

A process is disclosed for producing from a pressurized methane-rich gas stream a pressurized methane-rich liquid stream having a temperature above −112° C. (−170° F.) and having a pressure sufficient for the liquid to be at or below its bubble point. In this process, a methane-rich liquid stream having a temperature below about −155° C. (−247° F.) is supplied and its pressure is increased. A pressurized methane-rich gas to be liquefied is supplied and introduced to the pressurized methane-rich liquid stream at a rate that produces a methane-rich liquid stream having a temperature above −112° C. (−170° F.) and a pressure sufficient for the liquid to be at or below its bubble point.

13 Claims, 1 Drawing Sheet

PROCESS FOR PRODUCING A PRESSURIZED METHANE-RICH LIQUID FROM A METHANE-RICH GAS

This application claims the benefit of U.S. Provisional Application No. 60/115,980, filed Jan. 15, 1999.

FIELD OF THE INVENTION

This invention relates to a process for producing pressurized methane-rich liquid from a methane-rich gas and, more particularly, to a process for producing pressurized liquid natural gas (PLNG) from natural gas.

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

One of the distinguishing features of a LNG plant is the large capital investment required for the plant. The equipment used to liquefy natural gas is generally quite expensive. The liquefaction plant is made up of several basic systems, including gas treatment to remove impurities, liquefaction, refrigeration, power facilities, and storage and ship loading facilities.

LNG refrigeration systems are expensive because so much refrigeration is needed to liquefy natural gas. A typical natural gas stream enters a LNG plant at pressures from about 4,830 kPa (700 psia) to about 7,600 kPa (1,100 psia) and temperatures from about 20° C. (68° F.) to about 40° C. (104° F.). Natural gas compositions at atmospheric pressure will typically liquefy in the temperature range between about −165° C. (−265° F.) and −155° C. (−247° F.). This significant reduction in temperature requires substantial refrigeration duty.

It has been recently proposed to transport natural gas at temperatures above −112° C. (−170° F.) and at pressures sufficient for the liquid to be at or below its bubble point temperature. For most natural gas compositions, the pressure of the natural gas at temperatures above −112° C. (−170° F.) will be between about 1,380 kPa (200 psia) and about 4,500 kPa (650 psia). This pressurized liquid natural gas is referred to as PLNG to distinguish it from LNG, which is transported at near atmospheric pressure and at a temperature of about −162° C. (−260° F.). The production of PLNG requires significantly less refrigeration than that required for the production of LNG since PLNG can be more than 50° C. warmer than conventional LNG at atmospheric pressure. Examples of processes for manufacturing PLNG are disclosed in U.S. patent applications Ser. No. 09/099262, 09/099590, and 09/099589 and in U.S. provisional application No. 60/079642. In view of the substantial economic benefits associated with making and transporting PLNG, a continuing need exists for improved processes for producing PLNG.

SUMMARY

An improved process is disclosed for producing from a pressurized methane-rich gas stream a pressurized methane-rich liquid stream having a temperature above −112° C. (−170° F.) and having a pressure sufficient for the liquid to be at or below its bubble point. In this process, a methane-rich liquid stream having a temperature below about −155° C. (−247° F.) is supplied and its pressure is increased. A pressurized methane-rich gas to be liquefied is supplied and introduced to the pressurized methane-rich liquid stream at a rate that produces a methane-rich liquid stream having a temperature above −112° C. (−170° F.) and a pressure sufficient for the liquid to be at or below its bubble point.

In a preferred embodiment, a pressurized liquid natural gas (PLNG) is produced by supplying LNG having a pressure near atmospheric pressure and pumping the LNG to the desired pressure of PLNG to be produced by the process. Natural gas is supplied to the process and the pressure is adjusted either up or down, if needed, to be at essentially the same pressure as the pressurized LNG. Depending on the available pressure of the natural gas, its pressure can be increased by a compression means or decreased by an expansion device such as a Joule-Thomson valve or turboexpander. The pressurized natural gas is then mixed with the pressurized LNG at a rate that produces PLNG having a temperature above −112° C. (−170° F.) and a pressure sufficient for the resulting liquid to be at or below its bubble point. The natural gas may optionally be cooled before it is mixed with the pressurized PLNG by any suitable cooling means. For example, the natural gas may be cooled by indirect heat exchange with an external cooling medium, by an expansion device that reduces the pressure of the natural gas, or by heat exchange with the pressurized LNG. The mixture produced by the mixing of the pressurized LNG and the pressurized natural gas may optionally be passed through a phase separator to remove any gas that remains unliquefied after the mixing. The liquid withdrawn from the separator is then passed to a suitable storage means for storage at a temperature above −112° C. (−170° F.) and a pressure sufficient for it to be at or below its bubble point.

BRIEF DESCRIPTION OF THE DRAWINGS

The present invention and its advantages will be better understood by referring to the following detailed description and the attached drawings, which are schematic flow diagrams of representative embodiments of this invention.

The drawings are not intended to exclude from the scope of the invention other embodiments that are the result of normal and expected modifications of these specific embodiments. Various required subsystems such as valves, flow stream mixers, and control systems have been deleted from the drawings for the purposes of simplicity and clarity of presentation.

DETAILED DESCRIPTION OF THE INVENTION

The process of this invention produces a pressurized methane-rich liquid product stream having a temperature above −112° C. (−170° F.) and having a pressure sufficient for the liquid to be at or below its bubble point. This liquid product is sometimes referred to in this description as PLNG. In the process of this invention, PLNG is made by pressurizing a methane-rich liquid, preferably liquid natural gas (LNG) at or near atmospheric pressure, to the desired pressure of the PLNG product to be produced by the process and introducing to the pressurized methane-rich liquid a pressurized methane-rich gas, preferably pressurized natural gas. The pressurized methane-rich liquid is warmed by the pressurized natural gas and the methane-rich gas is liquefied by the pressurized methane-rich liquid to produce PLNG having a temperature above −112° C. (−170° F.) and having a pressure sufficient for the liquid to be at or below its bubble point.

The term "bubble point" as used in this description with respect to PLNG means the temperature and pressure at which PLNG begins to convert to gas. For example, if a certain volume of PLNG is held at constant pressure, but its temperature is increased, the temperature at which bubbles of gas begin to form in the PLNG is the bubble point. Similarly, if a certain volume of PLNG is held at constant temperature but the pressure is reduced, the pressure at which gas begins to form defines the bubble point. At the bubble point, the liquefied gas is saturated liquid. For most natural gas compositions, the bubble point pressure of the natural gas at temperatures above −112° C. (−170° F.) will be between about 1,380 kPa (200 psia) and about 4,500 kPa (650 psia). For a given natural gas composition having a particular temperature, persons skilled in the art can determine the bubble point pressure.

Figure 1:
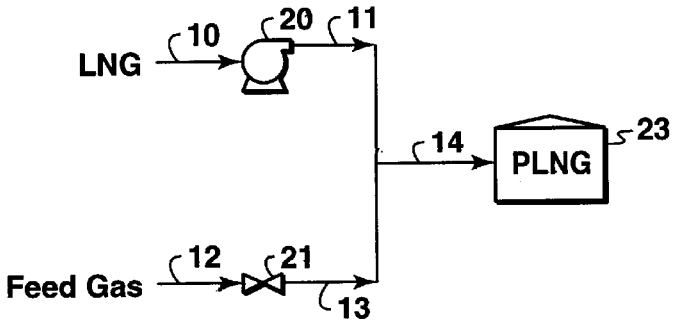
FIG. 1 is a schematic diagram of one embodiment of the present invention in which pressurized natural gas is combined with pressurized LNG to produce PLNG.

The process of this invention will now be described with reference to the drawings. Referring to FIG. 1, LNG from any suitable source is supplied to line 10 and is passed to a suitable pump 20. The LNG can be supplied for example by a pipeline from a LNG plant, from a stationary storage container, or from a carrier such as one or more containers on a truck, barge, railcar, or ship. The LNG will typically have a temperature below about −155° C. (−247° F.) and more typically will have a temperature of about −162° C. (−260° F.) and will have a pressure at near atmospheric pressure. Pump 20 increases the pressure of the LNG to a predetermined level, which is the desired pressure of the PLNG to be produced by the process of this invention. The pressure of the PLNG product is sufficient for the liquid to be at or below its bubble point. The pressure of the PLNG product will therefore depend on the temperature and composition of the PLNG product. For the PLNG to be at or below its bubble point temperature and to have a temperature above −112° C. (−170° F.), the pressure of the liquid exiting pump 20 through line 11 will typically will have a pressure above 1,380 kPa (200 psia) and more typically will have a pressure ranging between about 2,400 kPa (350 psia) and 3,800 kPa (550 psia).

Natural gas is supplied to line 12 from any suitable source. The natural gas suitable for the process of this invention may comprise natural gas obtained from a crude oil well (associated gas) or from a gas well (non-associated gas). The composition of natural gas can vary significantly. As used herein, a natural gas stream contains methane ($C_1$) as a major component. The natural gas will typically also contain ethane ($C_2$), higher hydrocarbons ($C_{3+}$), and minor amounts of contaminants such as water, carbon dioxide ($CO_2$), hydrogen sulfide, nitrogen, butane, hydrocarbons of six or more carbon atoms, dirt, iron sulfide, wax, and crude oil. The solubilities of these contaminants vary with temperature, pressure, and composition. At cryogenic temperatures, $CO_2$, water, and other contaminants can form solids, which could cause fluid flow problems in equipment associated with transporting and storing the PLNG. These potential difficulties can be avoided by removing such contaminants if conditions are anticipated that would form solids when the natural gas in line 13 is mixed with pressurized LNG.

In the following description of the invention, it is assumed that the natural gas stream in line 12 has been suitably treated to remove sulfides and carbon dioxide and dried to remove water using conventional and well-known processes to produce a "sweet, dry" natural gas stream. If the natural gas feed stream contains heavy hydrocarbons which could freeze out during mixing with the pressurized LNG or if the heavy hydrocarbons are not desired in the PLNG, the heavy hydrocarbon can be removed by a conventional fractionation process at any point in the process of this invention before the natural gas is mixed with the pressurized LNG.

The natural gas feed stream 12 will typically enter the process at a pressure above about 1,380 kPa (200 psia), and more typically will enter at a pressure above about 4,800 kPa (700 psia), and will typically be at ambient temperature; however, the natural gas can be at different pressures and temperatures, if desired, and the process can be modified accordingly. For example, if natural gas in line 12 is below the pressure of pressurized LNG in line 11, the natural gas can be pressurized by a suitable compression means (not shown), which may comprise one or more compressors. In this description of the process of this invention, it is assumed that the natural gas stream supplied to line 12 has a pressure at least as high as the pressure of pressurized LNG in line 11.

Pressurized natural gas in line 12 is preferably passed to a flow control device 21 suitable for controlling flow and/or reducing pressure between line 12 and line 13. Since natural gas will typically be supplied at a pressure greater than the pressure of LNG in line 11, flow control device 21 can be in the form of a turboexpander, a Joule-Thomson valve, or a combination of both, such as, for example, a Joule-Thomson valve and a turboexpander in parallel, which provides the capability of using either or both the Joule-Thomson valve and the turboexpander simultaneously. By using an expanding device such a Joule-Thomson valve or a turboexpander to expand the natural gas to reduce its pressure, the natural gas is also cooled. Cooling of the natural gas is desirable, although not a required step in the process, because decreasing the temperature of the natural gas before it is mixed with the pressurized LNG can increase the amount of PLNG produced.

Although not required in the practice of this invention, it may be desirable to further cool the natural gas by an additional cooling means not shown in the drawings. The additional cooling means may comprise one or more heat exchange systems cooled by conventional refrigeration systems or one or more expansion devices such as Joule-Thomson valves or turboexpanders. The optimum cooling system would depend on the availability of refrigeration cooling, space limitations, if any, environmental and safety considerations, and the desired amount of PLNG to be produced. In view of the teachings of this invention, persons skilled in the art of gas processing can select a suitable cooling system taking into account the operating circumstances of the liquefaction process.

The methane-rich liquid in line 11 and the natural gas of line 13 are combined or mixed to produce a combined liquid stream in line 14. The liquid in line 14 is directed to a suitable storage means 23 such as a stationary storage container or a suitable carrier such as a ship, barge, submarine vessel, railroad tank car, or truck. In accordance with the practice of this invention, PLNG in storage means 23 will have a temperature above about −112° C. (−170° F.) and a pressure sufficient for the liquid to be at or below its bubble point.

Figure 2:
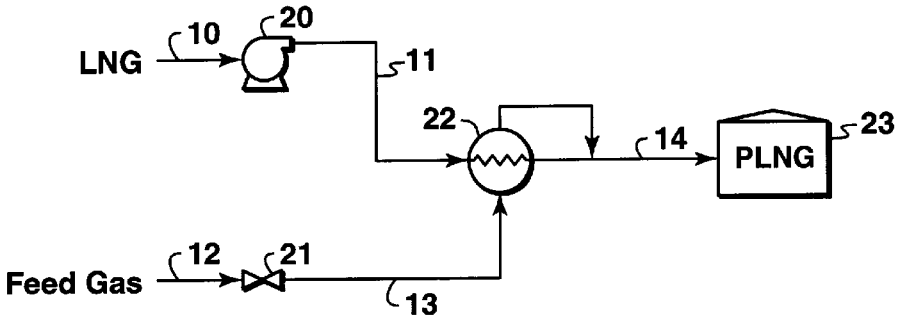
FIG. 2 is a schematic diagram of another embodiment of the present invention similar to the embodiment of FIG. I except that pressurized LNG and pressurized natural gas are passed through a heat exchanger before being combined to produce PLNG.
Figure 3:
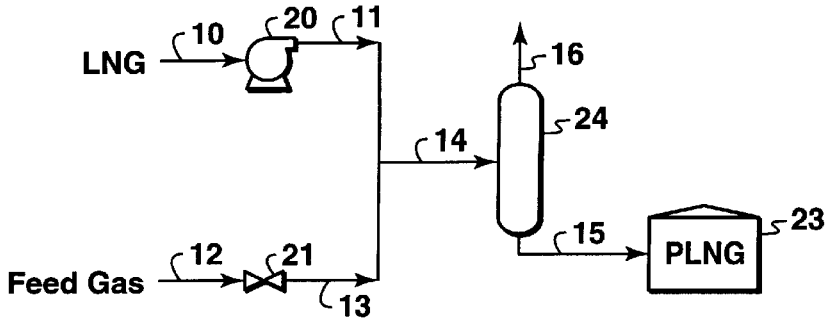
FIG. 3 is a schematic diagram of still another embodiment of the invention similar to the embodiment of FIG. 1 except that liquid mixture resulting from mixing of pressurized LNG and pressurized natural gas is passed to a phase separator to remove any unliquefied gas.

FIG. 2 illustrates another embodiment of the invention and in this and the embodiments illustrated in FIGS. 1 and 3, the parts having like numerals have the same process functions. Those skilled in the art will recognize, however, that the process equipment from one embodiment to another may vary in size and capacity to handle different fluid flow rates, temperatures, and compositions. The embodiment illustrated in FIG. 2 is similar to the embodiment illustrated in FIG. 1 except that in FIG. 2 pressurized LNG in line 11 and pressurized gas in line 13 are both passed to a conventional heat exchanger 22 to heat the pressurized LNG in line 11 and to further cool natural gas in line 13 before the pressurized LNG and the natural gas are combined (line 14). By cooling the natural gas against the pressurized LNG in the heat exchanger 22, the LNG is warmed to near the temperature of the pressurized LNG before the natural gas and the pressurized LNG are mixed. This could reduce the potential for formation of solids from components in the feed natural gas at the colder (−162° C.) LNG temperature.

The flow rate of methane-rich fluids passing through lines 11 and/or 13 should be controlled to produce the desired temperature of PLNG. The temperature of the PLNG is to be above −112° C. as a minimum temperature and below its critical temperature as a maximum temperature. Natural gas, which is predominantly methane, cannot be liquefied at ambient temperature by simply increasing the pressure, as is the case with heavier hydrocarbons used for energy purposes. The critical temperature of methane is −82.5° C. (−116.5° F.). This means that methane can only be liquefied below that temperature regardless of the pressure applied. Since natural gas is a mixture of liquid gases, it liquefies over a range of temperatures. The critical temperature of natural gas is typically between about −85° C. (−121° F.) and −62° C. (−80° F.). This critical temperature will be the theoretical maximum temperature of PLNG in PLNG storage containers, but the preferred storage temperature will be several degrees below the critical temperature and at a lower pressure than its critical pressure.

If the amount of natural gas through line 13 is too large relative to the amount of pressurized liquid in line 11, the resulting mixture in line 14 will be above its bubble point and at least part of the mixture will be in a gaseous state. On the other hand, if the amount of natural gas through line 13 is too small relative to the amount of pressurized liquid in line 11, the temperature of the combined stream (line 14) will be below −112° C. (−170° F.). Avoiding temperatures below −112° C. (−170° F.) is desirable to prevent exposing the materials used in handling and storage of PLNG to temperatures below the design temperature of the materials. Significant cost advantages can be obtained by using pipes, containers, and equipment made of materials that have a design temperature that doesn't fall significantly below about −112° C. (−170° F.). Examples of suitable materials for making, transporting, and storing PLNG are disclosed in U.S. patent applications Ser. No. 09/099649, 09/099153, and 09/099152.

Since the temperature of LNG in lines 10 and 11 is about −162° C., the materials used in lines 10 and 11 and pump 20 must be made of materials suitable for such cryogenic temperatures. Persons skilled in the art would be familiar with materials suitable for constructing piping, containers, and other equipment used in the process of this invention.

FIG. 3 illustrates another embodiment of the invention, which is similar to the embodiment illustrated in FIG. 1 except that the combined pressurized LNG and pressurized natural gas in line 14 is passed to a conventional phase separator 24 to removed any unliquefied gas that remains after the natural gas (line 13) is mixed with the pressurized LNG (line 11). Depending on the composition of the natural gas supplied to the process through line 12, some of the gas after being mixed with pressurized LNG may remain in a gaseous state. For example, the gas may not completely liquefy at the desired temperature and pressure if the natural gas contains significant levels of a component having a lower boiling point than methane, such as nitrogen. If the natural gas supplied to the process (line 12) contains nitrogen, the gas removed through line 16 from separator 24 will be enriched in nitrogen and the liquid exiting through line 15 will be leaner in nitrogen. The gas stream (line 16) exiting the separator 24 may be removed from the process for use as fuel or for further processing. The PLNG exiting the separator 24 is passed through line 15 to a storage means 23.

In one application of the present invention, the process can be used to produce more liquid natural gas than the design capacity of a LNG plant with minimal additional equipment. In the practice of this invention, LNG produced by a conventional LNG plant can provide the refrigeration needed to liquefy natural gas, thereby substantially increasing the amount of liquid natural gas that can be produced as a product. In another application of this invention, under circumstances in which only part of a LNG plant's capacity is needed for supply of LNG for conventional usage, the remaining capacity of the LNG plant could be used to supply the LNG to the process of this invention. In still another application, part or all of the LNG delivered by ship to an import terminal may be supplied to the process of this invention to produce PLNG for subsequent distribution.

EXAMPLE

Simulated mass and energy balances were carried out to illustrate the embodiment shown in FIG. 1, and the results are shown in the Table below.

The data were obtained using a commercially available process simulation program called HYSYS™ (available from Hyprotech Ltd. of Calgary, Canada); however, other commercially available process simulation programs can be used to develop the data, including for example HYSIM™, PROII™, and ASPEN PLUS™, which are familiar to those of ordinary skill in the art. The data presented in the Table are offered to provide a better understanding of the embodiment shown in the drawing, but the invention is not to be construed as unnecessarily limited thereto. The temperatures and flow rates are not to be considered as limitations upon the invention, which can have many variations in temperatures and flow rates in view of the teachings herein. In this example, flow control device 21 was a Joule-Thomson valve.

A person skilled in the art, particularly one having the benefit of the teachings of this patent, will recognize many modifications and variations to the specific processes disclosed above. For example, a variety of temperatures and pressures may be used in accordance with the invention, depending on the overall design of the system and the composition of the feed gas. As discussed above, the specifically disclosed embodiments and examples should not be used to limit or restrict the scope of the invention, which is to be determined by the claims below and their equivalents.

TABLE

| Stream # | Phase Vapor/ Liquid | Temperature ° C. | Temperature ° F. | Pressure kPa | Pressure psia | Flow Rate kg mol/hr | Flow Rate lb mol/hr | Composition, mole % $C_1$ | $C_2$ | $C_3$ | $iC_4$ | $nC_4$ | $C_5^+$ | $N_2$ | $CO_2$ |
|---|---|---|---|---|---|---|---|---|---|---|---|---|---|---|---|
| 10 | L | −161 | −258 | 103 | 14.9 | 4963 | 10940 | 91.1 | 5.9 | 2.0 | 0.5 | 0.3 | 0.0 | 0.2 | 0.0 |
| 11 | L | −159 | −354 | 2930 | 415 | 4963 | 19040 | 91.1 | 5.9 | 2.0 | 0.5 | 0.3 | 0.0 | 0.2 | 0.0 |
| 12 | V | 38 | 100 | 4137 | 600 | 1877 | 4137 | 91.1 | 5.9 | 2.0 | 0.5 | 0.3 | 0.0 | 0.2 | 0.0 |
| 13 | V | 32 | 89 | 2930 | 415 | 1877 | 4137 | 91.1 | 5.9 | 2.0 | 0.5 | 0.3 | 0.0 | 0.2 | 0.0 |
| 14 | L | −94 | −137 | 2930 | 415 | 6840 | 15077 | 91.1 | 5.9 | 2.0 | 0.5 | 0.3 | 0.0 | 0.2 | 0.0 |

What is claimed is:

1. A process for producing a pressurized methane-rich liquid product stream having a temperature above −112° C. (−170° F.) from a pressurized methane-rich gas, comprising the steps of:

(a) supplying a methane-rich liquid having a temperature below about −155° C. (−247° F.) and pressurizing the methane-rich liquid; and (b) supplying the pressurized methane-rich gas and introducing it to the pressurized methane-rich liquid at a rate that produces a pressurized methane-rich liquid product stream having a temperature above −112° C. (−170° F.) and having a pressure sufficient for it to be at or below its bubble point.

2. The process of claim 1 wherein the pressure of the pressurized methane-rich liquid of step (a) and the pressure of the pressurized methane-rich gas are at essentially the same pressures.

3. The process of claim 1 wherein the pressure of the pressurized methane-rich gas supplied to the process exceeds the pressure of the pressurized methane-rich liquid of step (a) and the process further comprising, before introducing the pressurized methane-rich gas to the pressurized methane-rich liquid of step (a), reducing the pressure of the pressurized methane-rich gas to approximately the same pressure as the pressurized methane-rich liquid of step (a).

4. The process of claim 1 wherein the methane-rich liquid of step (a) is LNG at or near atmospheric pressure.

5. The process of claim 1 wherein the pressurized methane-rich gas is natural gas.

6. The process of claim 1 wherein pressurized methane-rich gas and the pressurized methane-rich liquid are passed through a heat exchanger to heat the pressurized methane-rich liquid and cool the pressurized methane-rich gas.

7. The process of claim 1 further comprising an additional step of cooling the pressurized methane-rich gas prior to its being introduced to the pressurized methane-rich liquid.

8. The process of claim 7 wherein the pressurized methane-rich gas is cooled by expanding the pressurized methane-rich gas to reduce its pressure to approximately the pressure of the pressurized methane-rich liquid.

9. The process of claim 7 wherein the pressurized methane-rich gas is cooled by indirect heat exchange in a cooling means.

10. The process of claim 1 further comprising the step of removing in a pre-treatment step gaseous components in the pressurized methane-rich gas that would form solids at the temperature of the pressurized methane-rich liquid product stream having a temperature above −112° C. (−170° F.) and having a pressure sufficient for it to be at or below its bubble point.

11. The process of claim 1 further comprising the additional step of passing the pressurized methane-rich product stream to a phase separator to produce a gas stream and a liquid stream, and passing the liquid stream produced by the phase separator to a storage means.

12. The process of claim 11 further comprising the additional step of storing the liquid in the storage means at a temperature above −112° C. (−170° F.) and a pressure essentially at its bubble point pressure.

13. A process for liquefying a pressurized natural gas stream to produce a pressurized liquid natural gas stream having a temperature above −112° C. (−170° F.) and a pressure essentially at its bubble point, comprising the steps of:

(a) supplying a methane-rich liquid stream having a temperature below about −155° C. (−247° F.);

(b) pressurizing the methane-rich liquid stream to a predetermined pressure;

(c) expanding the methane rich gas stream to reduce its pressure to approximately the same pressure as the predetermined pressure; and (d) combining a sufficient amount of the expanded methane-rich gas stream with the pressurized methane-rich liquid stream to liquefy the expanded gas stream and to produce a methane-rich product stream having a temperature above −112° C. (−170° F.) and a pressure sufficient for the product stream to be at or below it bubble point.

* * * * *